US009048584B2

(12) United States Patent
Thackston et al.

(10) Patent No.: US 9,048,584 B2
(45) Date of Patent: Jun. 2, 2015

(54) ELECTRICAL CONNECTOR SYSTEM HAVING AN INSULATOR HOLDING TERMINALS

(71) Applicant: Tyco Electronics Corporation, Berwyn, PA (US)

(72) Inventors: Kevin Michael Thackston, York, PA (US); Dustin Carson Belack, III, Hummelstown, PA (US); Chong Hun Yi, Mechanicsburg, PA (US); Albert Tsang, Harrisburg, PA (US); Matthew Richard McAlonis, Elizabethtown, PA (US); Nicholas Paul Ruffini, York, PA (US); Keith Edwin Miller, Manheim, PA (US); Scott Eric Walton, Mount Joy, PA (US); James Showers, Stewartstown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 179 days.

(21) Appl. No.: 13/755,875

(22) Filed: Jan. 31, 2013

(65) Prior Publication Data

US 2014/0213108 A1 Jul. 31, 2014

(51) Int. Cl.
*H01R 13/648* (2006.01)
*H01R 13/6581* (2011.01)
*H01R 24/62* (2011.01)

(52) U.S. Cl.
CPC ..... *H01R 13/648* (2013.01); *H01R 13/6581* (2013.01); *H01R 24/62* (2013.01)

(58) Field of Classification Search
CPC ..... H01R 13/65802; H01R 13/658; H01R 23/6873; H01R 23/7073
USPC ..... 439/607.01, 607.35, 607.45, 607.46, 439/607.5, 607.51, 660
See application file for complete search history.

(56) References Cited

U.S. PATENT DOCUMENTS

| | | | | | |
|---|---|---|---|---|---|
| 5,073,127 | A | * | 12/1991 | Daly et al. | 439/473 |
| 5,232,380 | A | * | 8/1993 | Inoue et al. | 439/607.5 |
| 5,295,866 | A | * | 3/1994 | Kroger et al. | 439/589 |
| 5,938,476 | A | * | 8/1999 | Wu et al. | 439/607.57 |
| 6,106,338 | A | * | 8/2000 | Wu et al. | 439/660 |
| 6,398,587 | B1 | * | 6/2002 | Chen et al. | 439/607.35 |
| 6,962,510 | B1 | | 11/2005 | Chen et al. | |
| 7,267,579 | B1 | | 9/2007 | Wu | |
| 7,357,679 | B2 | * | 4/2008 | Wang | 439/660 |

(Continued)

FOREIGN PATENT DOCUMENTS

WO 2004110192 A1 12/2004

OTHER PUBLICATIONS

International Search Report, International Application No. PCT/US2014/011233, International Filing Date, Jan. 13, 2014.

*Primary Examiner* — Thanh Tam Le

(57) ABSTRACT

An electrical connector is provided for terminating a plurality of electrical conductors. The electrical connector includes a terminal subassembly having terminals configured to be electrically connected to the electrical conductors. The terminal subassembly has an insulator holding the terminals. The terminal subassembly has a mating interface where mating surfaces of the terminals mate with a mating connector. The mating interface of the terminal subassembly is approximately flat. The electrical connector also includes a metal shell holding the terminal subassembly. The metal shell has the cross-sectional shape of an oval.

16 Claims, 7 Drawing Sheets

(56) References Cited

U.S. PATENT DOCUMENTS

| | | | | |
|---|---|---|---|---|
| 7,618,293 | B2 * | 11/2009 | Wu | 439/660 |
| 7,717,733 | B1 * | 5/2010 | Yi et al. | 439/452 |
| 7,798,853 | B2 * | 9/2010 | Shi et al. | 439/607.58 |
| 8,430,693 | B2 * | 4/2013 | Wu | 439/607.5 |
| 2012/0071015 | A1 | 3/2012 | Debock et al. | |
| 2012/0276777 | A1 | 11/2012 | Lv et al. | |

* cited by examiner

ELECTRICAL CONNECTOR SYSTEM HAVING AN INSULATOR HOLDING TERMINALS

BACKGROUND OF THE INVENTION

The subject matter described and/or illustrated herein relates generally to electrical connectors.

Electrical connector system are used to electrically connect a wide variety of electronic devices. But, known electrical connectors are not without disadvantages. For example, at least some known electrical connectors are not shielded to meet EMI/RFI demands in the field, which may cause excessive interference with the data signals. Moreover, and for example, at least some known electrical connectors have a circular shape that may be easily snagged. Such circular electrical connectors may also have a large enough profile that causes difficulty mounting the circular electrical connector to a wearable article. For example, the circular electrical connector may be too bulky and/or may cause irritation to a person who is wearing the wearable article. Another problem with circular electrical connectors is that the terminals thereof are not capable of being cleaned in the field. For example, the mating interfaces of at least some known circular electrical connectors are shrouded, which enables collection of debris, which can not be easily cleaned in the field. Attempts to clean such interfaces typically lead to damage of the terminals of the connector.

BRIEF DESCRIPTION OF THE INVENTION

In one embodiment, an electrical connector is provided for terminating a plurality of electrical conductors. The electrical connector includes a terminal subassembly having terminals configured to be electrically connected to the electrical conductors. The terminal subassembly has an insulator holding the terminals. The terminal subassembly has a mating interface where mating surfaces of the terminals mate with a mating connector. The mating interface of the terminal subassembly is approximately flat. The electrical connector also includes a metal shell holding the terminal subassembly. The metal shell has the cross-sectional shape of an oval.

In another embodiment, an electrical connector is provided for terminating a plurality of electrical conductors. The electrical connector includes an insulator having grooves and ribs that extend between adjacent grooves. The electrical connector also includes terminals held by the insulator. The terminals have terminating ends that are configured to be electrically connected to the electrical conductors. The terminals have mating ends that include mating surfaces where the terminals are configured to mate with a mating connector. The mating ends of the terminals are deflectable springs that are aligned with corresponding grooves such that the mating ends are configured to be deflected into the corresponding grooves. The ribs are configured to protect the mating ends of the terminals from over-deflection. The electrical connector also includes a metal shell holding the terminal subassembly.

In another embodiment, an electrical connector system includes a first connector having a first terminal subassembly and a first metal shell. The first terminal subassembly is held by the first metal shell and includes a first group of terminals. The first metal shell includes a sealing ring. The electrical connector system includes a second connector configured to mate with the first connector. The second connector has a second metal shell and a second terminal subassembly that is held by the second metal shell. The second terminal subassembly includes a second group of terminals that is configured to mate with the first group of terminals of the first connector. The second metal shell includes a terminating segment and a tunnel that extends outward from the terminating segment. The tunnel has an open end defined by at least one interior surface of the tunnel. The first metal shell is configured to be received within the open end of tunnel such that the first and second connectors mate together within the tunnel. The sealing ring is configured to sealingly engage with the interior surface of the tunnel to seal the open end of the tunnel when the first and second connectors are mated together within the tunnel.

DETAILED DESCRIPTION OF THE INVENTION

Figure 1:
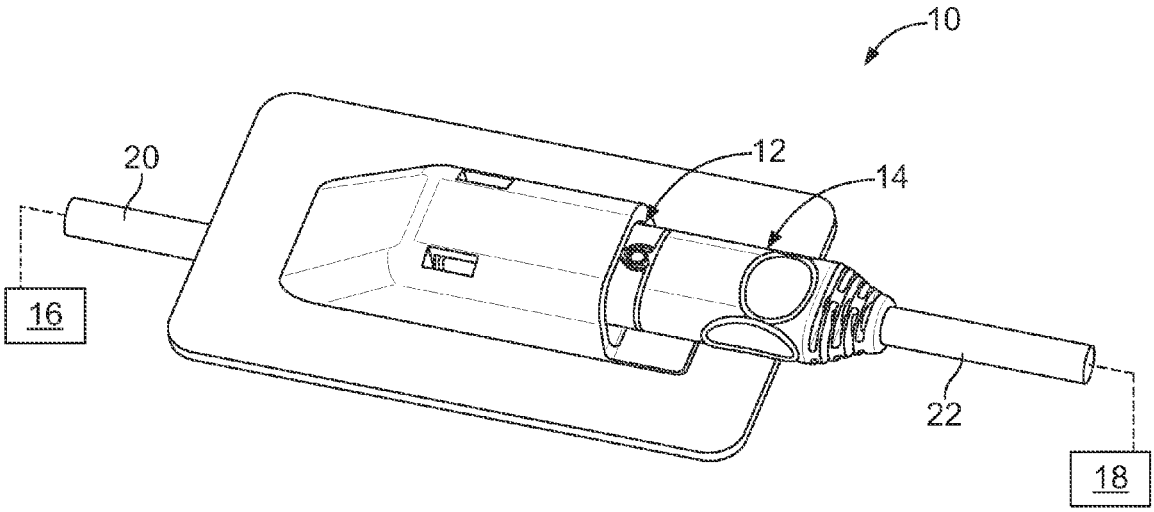
FIG. 1 is a perspective view of an exemplary embodiment of an electrical connector system.

FIG. 1 is a perspective view of an exemplary embodiment of an electrical connector system 10. The electrical connector system 10 includes electrical connectors 12 and 14 that mate together to form an electrical connection therebetween. The electrical connector system 10 is provided along an electrical path between two electronic devices 16 and 18 for providing a separable electrical connection between the electronic devices 16 and 18. As will be described below, the electrical connector system 10 is optionally mounted to a wearable article (not shown), such as, but not limited to, a vest, a shirt, a jacket, pants, trousers, a boot, a shoe, a helmet, a hat, a cap, a coat, armor, and/or the like. Each of the electrical connectors 12 and 14 may be referred to herein as a "mating connector", a "first" connector, and/or a "second" connector.

Each of the devices 16 and 18 may be any type of electronic device. In an exemplary embodiment, the electronic device 16 constitutes a battery pack and the electronic device 18 constitutes an LED array that may be powered by the battery pack. Other types of electronic devices may be interconnected by the electrical connector system 10 in other embodiments.

In the illustrated embodiment, the connector 12 is electrically connected to the electronic device 16 via a cable 20. The cable 20 may have any length. In other words, the connector 12 terminates the electrical cable 20. In alternative to the cable 20, the connector 12 may be mounted directly to the electronic device 16 or may be electrically connected to the electronic device 16 via an e-textile (not shown) that includes fabrics that enable computing, digital components, electrical pathways, and/or electronic devices to be embedded therein. Specifically, the e-textile provides a wearable article with wearable technology that allows for the incorporation of built-in technological elements into the fabric of the wearable article. The wearable article may constitute intelligent clothing or smart clothing.

The connector 14 is also shown in the illustrated embodiment as being electrically connected to the corresponding electronic device 18 via a corresponding cable 22. But, in other embodiments, the connector 14 may be mounted directly to the electronic device 16 or may be electrically connected to the electronic device 16 via the electrical conductors (not shown) of an e-textile (not shown).

Figure 2:
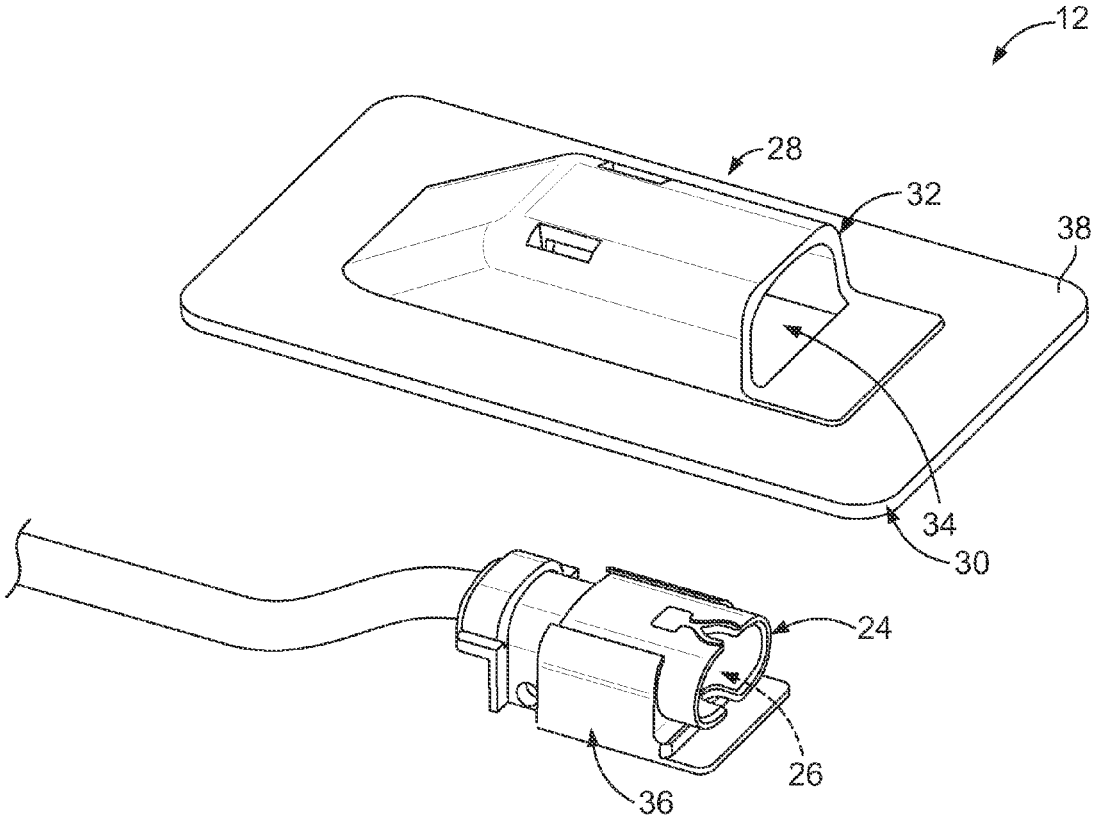
FIG. 2 is a partially exploded perspective view of an exemplary embodiment of an electrical connector of the electrical connector system shown in FIG. 1.

FIG. 2 is a partially exploded perspective view of an exemplary embodiment of the electrical connector 12. The connector 12 includes a metal shell 24 and a terminal subassembly 26 (best seen in FIGS. 3 and 5) held by the metal shell 24. Optionally, the connector 12 includes a holder 28. For example, as discussed above, the electrical connector system 10 is optionally held by a wearable article. In the illustrated embodiment, the holder 28 is used to mount the connector 12 of the connector system 10 to the wearable article. The holder 28 includes a base 30 and a shroud 32. The shroud 32 defines a chamber 34 of the holder 28. As will be described below with reference to FIG. 5, the connector 12 is held by the holder 28 such that the connector 12 extends within the chamber 34. The connector 12 optionally includes a fixture 36 that cooperates with the holder 28 for securely holding the connector 12 within the chamber 34.

The holder 28 is mounted to the wearable article to thereby mount the connector 12 to the wearable article. The holder 28 may be mounted to the wearable article using any type of connection, such as, but not limited to, by being sewn to the wearable article, by being adhered to the wearable article using an adhesive, and/or the like. In the illustrated embodiment, the base 30 of the holder 28 includes a flange 38 through which a thread may be routed to sew the holder 28 to the wearable article. Optionally, the holder 28 may be mounted to the wearable article within and/or under a pocket and/or other covering of the wearable article. For example, a flap may cover a portion or all of the holder 28 and/or the connector 12.

Figure 3:
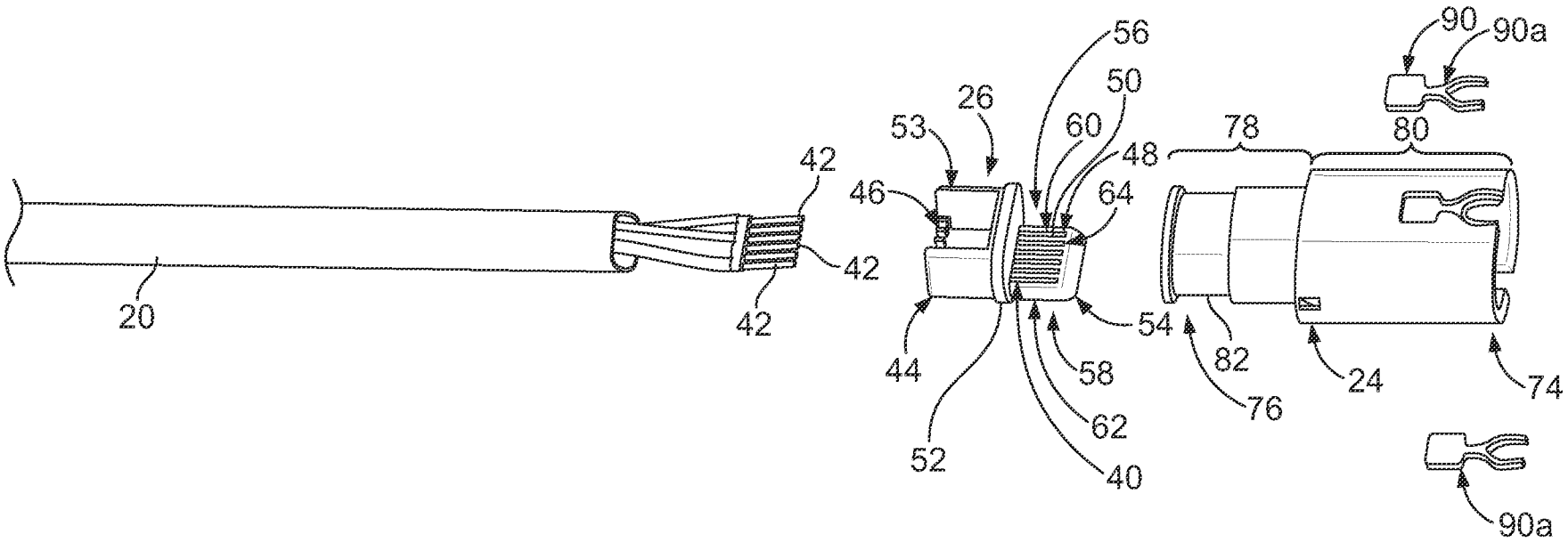
FIG. 3 is an exploded perspective view of the electrical connector shown in FIG. 2.

FIG. 3 is an exploded perspective view of the electrical connector 12. The holder 28 and fixture 36 are not shown in FIG. 3. The connector 12 includes the terminal subassembly 26 and the metal shell 24 that holds the terminal subassembly 26. The terminal subassembly 26 has a plurality of terminals 40 that are configured to be electrically connected to corresponding electrical conductors 42 of the cable 20. The terminal subassembly 26 has an insulator 44 that holds the terminals 40. The insulator 44 electrically isolates the terminals 40 from the metal shell 24 and may provide impedance control, such as by positioning the terminals 40 at predetermined locations to achieve a target characteristic impedance. In the illustrated embodiment, the insulator 44 is manufactured from a single piece, but the insulator 44 may alternatively be manufactured from two or more pieces that connect together to define the insulator 44. The insulator 44 may be manufactured from any number of pieces. The terminal subassembly 26 may be referred to herein as a "first" and/or a "second" terminal subassembly.

The terminals 40 have terminating ends 46 and mating ends 48. The mating ends 48 have mating surfaces 50 configured for mating with the electrical connector 14 (FIGS. 1 and 6-8). The terminating ends 46 are configured to be electrically connected to corresponding electrical conductors 42 of the cable 20. In an exemplary embodiment, the terminating ends 46 are configured to be ultrasonically welded to the electrical conductors 42. Alternatively, the terminating ends 46 may be terminated to the electrical conductors 42 in a different manner, such as by soldering, crimping, and/or by other means. Optionally, the terminating ends 46 may be compression crimped to the electrical conductors 42. Each of the terminals 40 may be a signal terminal, a ground terminal, or a power terminal.

The insulator 44 includes a base 52, a terminating segment 53 that extends outward from the base 52, and a platform 54 that extends outward from the base 52. The terminating ends 46 of the terminals 40 extend along the terminating segment 53 of the insulator 44 for electrical connection to the corresponding electrical conductors 42 of the cable 20.

The platform 54 includes a terminal side 56, an opposite side 58, and two side ends 60 and 62 that each extend from the terminal side 56 to the opposite side 58. The mating ends 48 of the terminals 40 are arranged along the platform 54. Specifically, the mating ends 48 of the terminals 40 are positioned on the terminal side 56 of the platform 54 such that the mating surfaces 50 are arranged along the terminal side 56 of the platform 54. The mating ends 48 of the terminals 40 rest on the terminal side 56 of the platform 54 such that the terminal side 56 supports the mating ends 48 of the terminals 40.

The mating surfaces 50 define a mating interface 64 of the terminal subassembly 26 where the mating surfaces 50 mate with corresponding terminals 66 (FIGS. 6-8) of the connector 14. As described above, the mating surfaces 50 of the terminals 40 are arranged along the terminal side 56 of the platform 54. Accordingly, the mating interface 64 of the connector 12 extends on the terminal side 56 of the platform 54.

Figure 4:
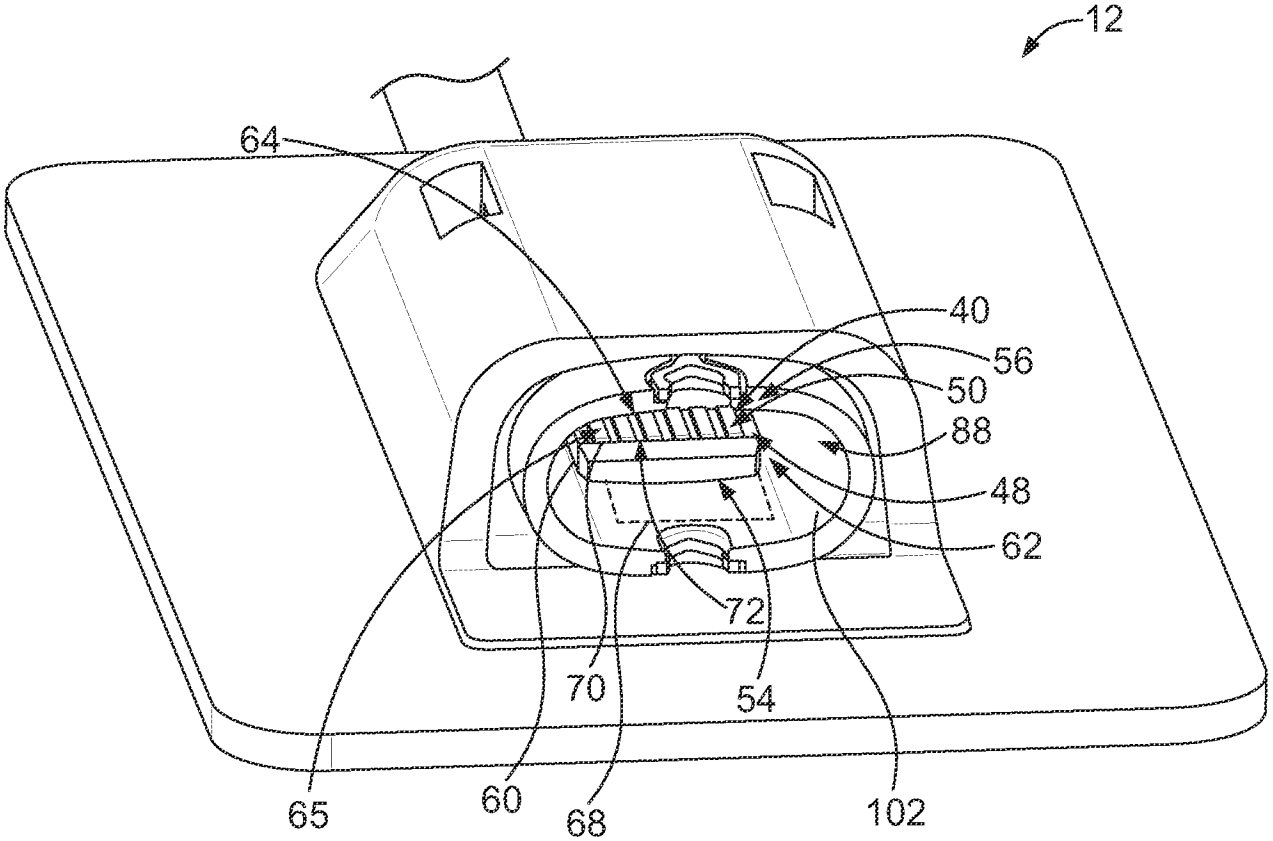
FIG. 4 is a perspective view of the electrical connector shown in FIGS. 2 and 3 illustrating the electrical connector as assembled.
Figure 5:
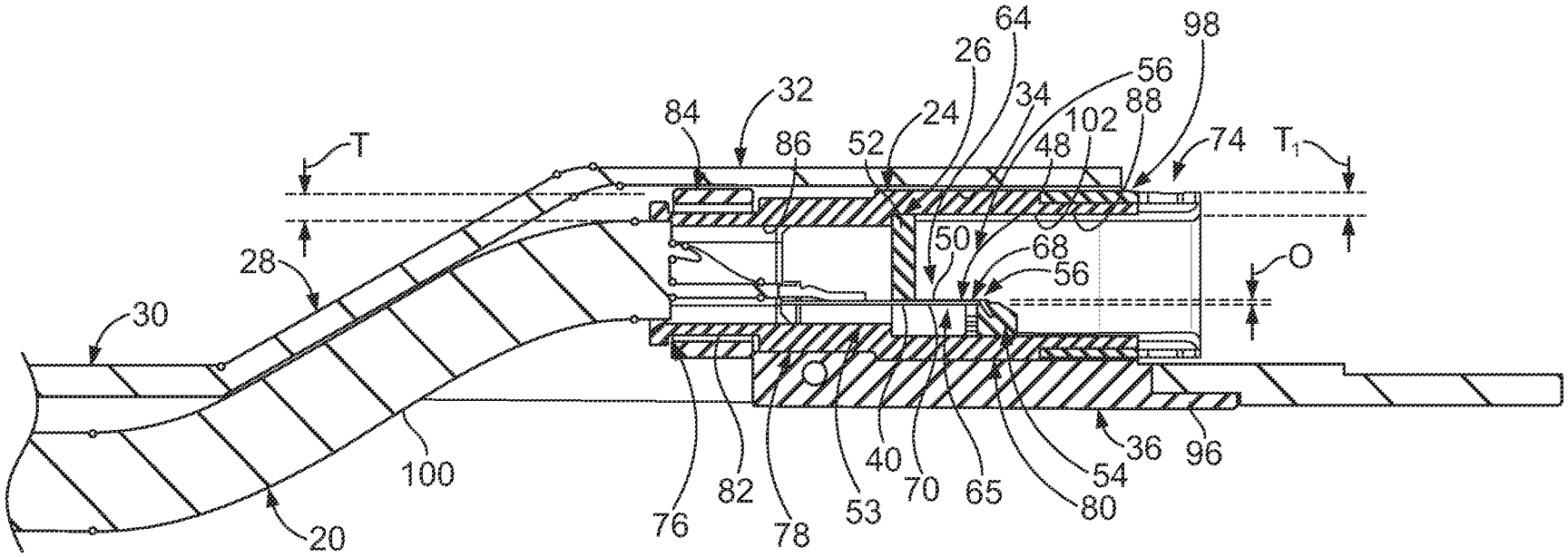
FIG. 5 is a cross-sectional view of the electrical connector shown in FIGS. 2-4.

The mating interface 64 of the terminal subassembly 26 is approximately flat. For example, and referring now to FIGS. 4 and 5, the mating surface 50 of each of the terminals 40 is approximately flat. As best seen in FIG. 4, the mating ends 48, and thus the mating surfaces 50, of the terminals 40 are arranged side by side in a row 65. As best seen in FIG. 5, the mating surfaces 50 of the terminals 40 extend approximately within the same plane 68. The approximately flat shapes of the mating surfaces 50 and the alignment within the common plane 68 provides the mating interface 64 of the connector 12 as approximately flat. The approximately flat mating interface 64 may provide a wipeable and/or cleanable surface for cleaning the mating surfaces 50 of the terminals 40. For example, a user may use their thumb, a cloth, and/or the like to wipe across the mating interface 64 to clear debris, dirt, other contaminants, and/or the like from the terminals 40. Moreover, the approximately flat mating interface 64 may trap less dirt, debris, other contaminants, and/or the like than the mating interfaces of at least some known electrical connectors. The approximately flat mating interface 64 may thus enable the mating surfaces 50 of the terminals 40 to be more reliable and/or be more easily cleaned than the terminals of at least some known electrical connectors. For example, the approximately flat mating interface 64 may enable the mating surfaces 50 of the terminals 40 to be cleaned without damaging the terminals 40. The approximately flat mating interface 64 may provide the connector 12 with a lower profile than at least some known electrical connectors.

Optionally, the terminal side 56 of the platform 54 includes grooves 70 that receive the mating ends 48 of corresponding terminals 40 therein. The mating surfaces 50 of the terminals 40 may be offset above the terminal side 56 of the platform 54 or may be flush (i.e., coplanar) with the terminal side 56. For example, in the illustrated embodiment, the mating surfaces 50 are offset O (not labeled in FIG. 4) above segments 72 (not visible in FIG. 5) of the terminal side 56 that extend between the mating ends 48 of the terminals 40. The grooves 70 and terminals 40 have a relative size that is selected to provide the offset O with a predetermined value. In other embodiments, the terminal side 56 of the platform 54 does not include the grooves 70 and the thickness of the mating ends 48 of the terminals 40 is selected to provide the offset O with a predetermined value. The offset O may have any value. As discussed above, in some alternative embodiments, the grooves 70 and terminals 40 have a relative size that is selected such that the mating surfaces 50 of the terminals 40 are flush (i.e., coplanar) with the segments 72 of the terminal side 56. In other words, the offset O may have a value of approximately zero in some alternative embodiments.

Referring again to FIG. 3, the metal shell 24 extends a length from a mating end 74 to an opposite terminating end 76. The metal shell 24 includes a terminating segment 78 and a tunnel 80 that extends outward from the terminating segment 78. The terminating segment 78 includes the terminating end 76 of the metal shell 24. The tunnel 80 includes the mating end 74. The metal shell 24 is configured to receive the electrical conductors 42 of the cable 20 through the terminating end 76 of the terminating segment 78. The terminals 40 of the connector 12 are configured to mate with the electrical connector 14 (FIGS. 1 and 6-8) within the tunnel 80. Optionally, the terminating segment 78 of the metal shell 24 includes a groove 82 that receives a flange 84 (FIG. 5) of the fixture 36 (FIGS. 2 and 5) therein to facilitate holding of the metal shell 24 by the fixture 36. The metal shell 24 may be referred to herein as a "first" and/or a "second" metal shell.

The metal shell 24 may include any metallic materials, such as, but not limited to, aluminum, copper, gold, silver, nickel, titanium, magnesium, platinum, another metal, and/or the like. In some embodiments, the metal shell 24 includes an aluminum alloy, a copper alloy, a gold alloy, a silver alloy, a nickel alloy, a titanium alloy, a magnesium ally, a platinum alloy, another metal alloy, and/or the like. Moreover, in some embodiments, an approximate entirety or a majority of the metal shell 24 is fabricated from one or more metals and/or metal alloys. In some embodiments, at least 90% of the metal shell 24 is fabricated from one or more metals and/or metal alloys. In the exemplary embodiment of the metal shell 24, an approximate entirety of the metal shell 24 is fabricated from one or more metals and/or metal alloys. Optionally, the metal shell 24 includes a base material (not shown) that is coated (e.g., plated and/or the like) with one or more different materials, whether or not the base material and/or the coating includes a metal and/or a metal alloy. One example of fabricating less than an approximate entirety of the metal shell 24 from one or more metals and/or metal alloys includes providing the metal shell 24 with a base material of one or more metals and/or metal alloys that is coated with one or more non-metallic materials, or vice versa. Any non-metallic materials that the metal shell 24 includes may or may not be electrically conductive.

The metal shell 24 is electrically conductive. Specifically, at least a portion of the metal shell 24 is electrically conductive such that the metal shell 24 defines an electrical path through the connector 12. In some embodiments, an approximate entirety of the metal shell 24 is electrically conductive. In other embodiments, one or more segments (e.g., a coating, a base material, and/or the like) is not electrically conductive. The electrical conductivity of the metal shell 24 enables the metal shell 24 to electrically shield the terminal subassembly 26. The electrical shielding may prevent or reduce electromagnetic interference (EMI) and/or radio frequency interference (RFI) on the signal paths defined through the connector 12. Such electrical shielding may allow relatively high speed data to be uninterrupted by the connector 12.

In the illustrated embodiment, the metal shell 24 is manufactured from a single piece, but the metal shell 24 may alternatively be manufactured from two or more pieces that connect together to define the metal shell 24. For example, the meal shell 24 may be defined by two portions (e.g., halves) that both include a portion of the terminating segment 78 and the tunnel 80 and that connect together to define the complete terminating segment 78 and the complete tunnel 80. Moreover, in the illustrated embodiment, the tunnel 80 is integrally formed with the terminating segment 78. But, the tunnel 80 may alternatively be a discrete component of the metal shell 24 that can be removably connected to the terminating segment 78. For example, the tunnel 80 may receive therein an end of the terminating segment 78 that is opposite the terminating end 76 to hold the tunnel 80 and terminating segment 78 together.

Referring again to FIG. 5, the terminating segment 78 of the metal shell 24 includes a cavity 86 that receives the terminating segment 53 of the terminal subassembly 26 therein. The cavity 86 extends through the length of the terminating segment 78 of the metal shell 24 such that the terminating segment 78 is open at the terminating end 76. The tunnel 80 extends outward from the terminating segment 78 to the mating end 74. The tunnel 80 includes an opening 88 that extends through the length of the tunnel 80 such that the opening 88 fluidly communicates with the cavity 86 and such that the tunnel 80 is open at the mating end 74. The tunnel 80 is configured to receive a portion of the electrical connector 14 into the opening 88 through the mating end 74.

The terminating segment 78 has a thickness T. The tunnel 80 has a thickness $T_1$. The thicknesses T and $T_1$ may each have any value. Various parameters of the metal shell 24 may be selected to provide the metal shell 24, and thus the connector 12, with a predetermined strength. Examples of such various parameters include, but are not limited to, the thickness T, the thickness $T_1$, the particular metallic materials of the metal shell, and/or the like. The predetermined strength of the metal shell 24 may reduce the likelihood that the metal shell 24 will structurally fail (e.g., fracture, break, collapse, and/or the like) during use within relatively rugged environments, such as, but not limited to, use when mounted to a wearable article, use within battlefields or other combat situations, field use, use within manufacturing facilities, use within construction sites, and/or the like. The predetermined strength of the metal shell 24 may enable the metal shell 24 to better protect the terminal sub-assembly 26 in relatively rugged environments. The predetermined strength of the metal shell 24 may enable the metal shell 24 to provide an increased amount of protection to the terminal subassembly 26 than at least some known electrical connectors. Examples of the thicknesses T and $T_1$ include, but are not limited to, between approximately 0.5 mm and approximately 2.0 mm, at least approximately 0.5 mm, and/or the like.

Referring again to FIG. 3, the tunnel 80 optionally includes securing features 90 for securing the connector 14 to the connector 12 when the connectors 12 and 14 are mated together. In the illustrated embodiment, the securing features 90 include electrical contacts **90*a* that are configured to mechanically and electrically connect with electrical pins 92*a* (FIGS. 6 and 8) of a metal shell 94 (FIGS. 6-8) of the connector 14 (FIGS. 1 and 6-8) to electrically and mechanically connect the metal shell 24 of the connector 12 to a metal shell 94 of the connector 14. Other types of securing features 90 may additionally or alternatively be used to electrically and/or mechanically connect the metal shells 24 and 94** together.

Referring now to FIGS. 3 and 4, the metal shell 24 has the cross-sectional shape of an oval. Specifically, the metal shell 24 has the cross-sectional shape of an oval taken along a cross section that extends approximately perpendicular to the length of the metal shell 24. In the illustrated embodiment, both the terminating segment 78 and the tunnel 80 have the cross-sectional shape of an oval. Alternatively, only the tunnel 80 or only the terminating segment 78 has the cross-sectional shape of an oval. As used herein, the term "oval" means a shape like an egg, an elliptical shape, an oblong shape, a figure that resembles two semicircles joined by a rectangle (e.g., like a cricket infield, an oval racing track, and/or the like), a rectangle with rounded corners, and/or the like. The oval cross-sectional shape of the metal shell 24 may facilitate providing the metal shell 24, and thus the connector 12, with a relatively low profile, which may facilitate use of the connector 12 when held by the wearable article. The oval cross-sectional shape of the metal shell 24 may provide the metal shell 24 with a lower profile than at least some known electrical connectors.

Referring again to FIG. 5, the metal shell 24 is held by the fixture 36. Specifically, in the illustrated embodiment, the flange 84 of the fixture 36 is received within the groove 82 of the metal shell 24 with a snap-fit connection to hold the metal shell 24 to the fixture 36. The fixture 36 is held by the holder 28 such that the metal shell 24 extends within the chamber 34 of the shroud 32 of the holder 28. The fixture 36 may include one or more tabs 96 and/or other securing features for mechanically connecting the fixture 36 to the holder 28. The fixture 36 is held by the holder 28 such that the terminating segment 78 of the metal shell 28 extends within the chamber 34 of the holder 28. The tunnel 80 extends outward from the terminating segment 78 toward an entrance 98 to the chamber 34. Optionally, the mating end 74 of the tunnel 80 extends past the entrance 98, as is shown in FIG. 5. In the illustrated embodiment, an insulator 100 of the cable 20 is sealingly engaged with the metal shell 24 at the terminating end 78 to seal the terminating end 78. The seal provided by such engagement may enable the connector 12 to be water tight. The shroud 32 and base 30 of the holder 28 also facilitate sealing the terminating end 78. In addition or alternatively to the engagement between the insulator 100 and the metal shell 24 and/or use of the holder 28, the connector 12 may include a grommet (not shown) and/or a boot (not shown) that seals the terminating end 78 of the metal shell 24.

As can be seen in FIG. 5, the terminating segment 53 of the terminal subassembly 26 is held within the cavity 86 of the terminating segment 78 of the metal shell 24. The base 52 and platform 54 extend into the opening 88 of the tunnel 80 for mating with the electrical connector 14. The tunnel 80 surrounds the platform 54 such that the mating interface 64 of the terminal subassembly 26 is exposed within the opening 88 of the tunnel 80 for mating with the connector 14. The tunnel 80 is spaced apart from the platform 54 along at least three sides of the platform 54. For example, as is better illustrated in FIG. 4, an interior surface 102 of the tunnel 80 that defines the opening 88 is spaced apart from the terminal side 56 and the side ends 60 and 62 of the platform 54.

Although six are shown, the connector 12 may include any number of the terminals 40. Optionally, four of the terminals 40 may be configured to operate at any universal serial bus (USB) standard, protocol, and/or the like, such as, but not limited to, USB 1.0, USB 2.0, USB 3.0, and/or the like.

Figure 6:
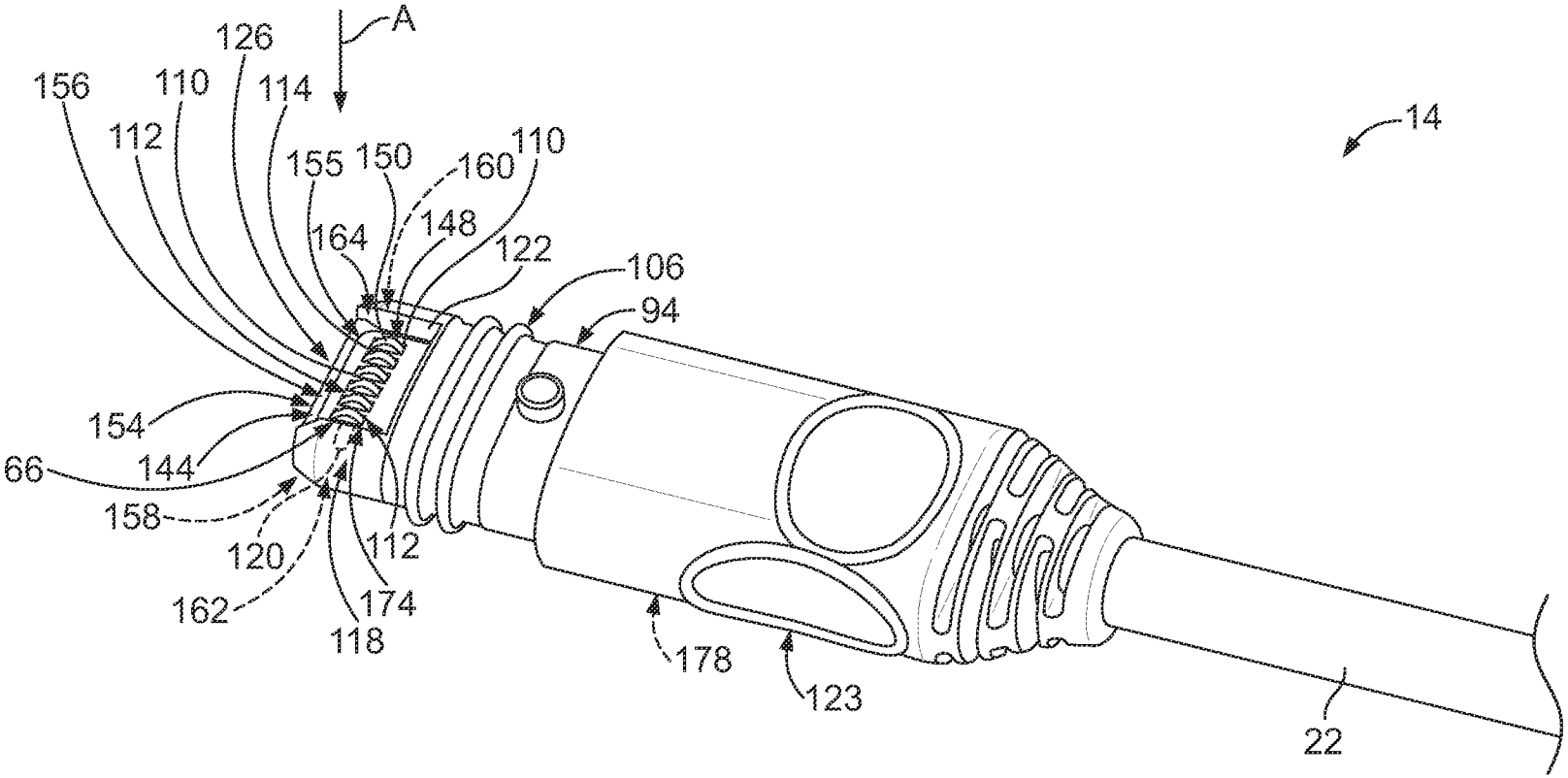
FIG. 6 is a perspective view of an exemplary embodiment of another electrical connector of the electrical connector system shown in FIG. 1.

FIG. 6 is a perspective view of an exemplary embodiment of the electrical connector 14. The connector 14 includes the metal shell 94 and a terminal subassembly 126 held by the metal shell 94. The terminal subassembly 126 has a plurality of the terminals 66, which are configured to be electrically connected to corresponding electrical conductors 142 (FIG. 7) of the cable 22. The terminal subassembly 126 has an insulator 144 that holds the terminals 66. The insulator 144 electrically isolates the terminals 66 from the metal shell 94 and may provide impedance control, such as by positioning the terminals 66 at predetermined locations to achieve a target characteristic impedance. The terminal subassembly 126 may be referred to herein as a "first" and/or a "second" terminal subassembly. The metal shell 94 may be referred to herein as a "first" and/or a "second" metal shell.

The connector 14 optionally includes a sealing ring 106 that extends around the metal shell 94. As will be described below, the sealing ring 106 is configured to sealingly engage the tunnel 80 (FIGS. 3-5 and 8) to seal the tunnel when the connectors 12 and 14 are mated together within the tunnel 80. The sealing ring 106 may have any size, shape, materials, structure, and/or the like. Optionally, the sealing ring 106 is elastomeric.

Figure 7:
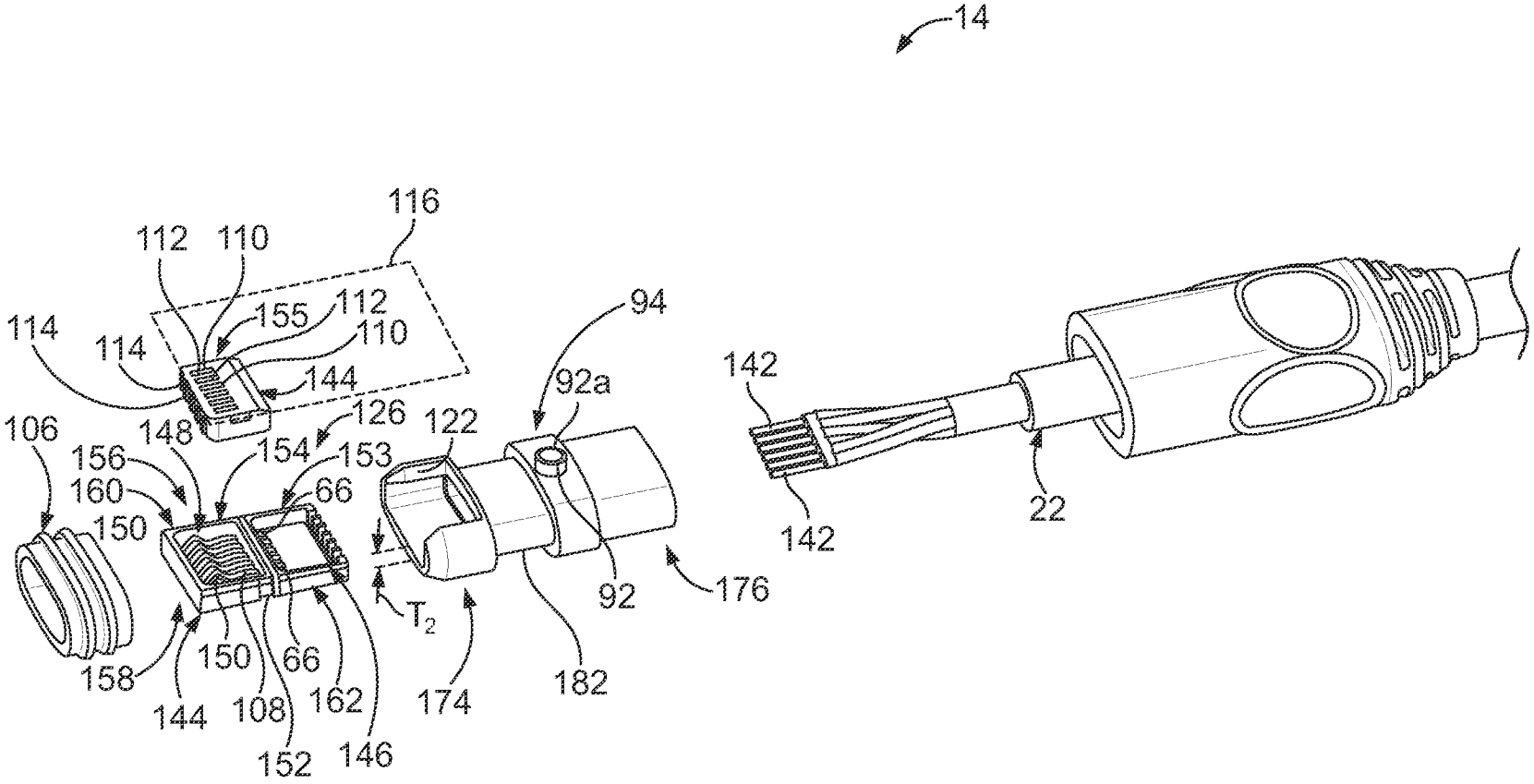
FIG. 7 is an exploded perspective view of the electrical connector shown in FIG. 6.

FIG. 7 is an exploded perspective view of the electrical connector 14. The terminals 66 have terminating ends 146 and mating ends 148. The mating ends 148 have mating surfaces 150 configured for mating with the electrical connector 12 (FIGS. 1-5 and 8). The terminating ends 146 are configured to be electrically connected to corresponding electrical conductors 142 of the cable 22. In an exemplary embodiment, the terminating ends 146 are configured to be ultrasonically welded to the electrical conductors 142. Alternatively, the terminating ends 146 may be terminated to the electrical conductors 142 in a different manner, such as by soldering, crimping, and/or by other means. Optionally, the terminating ends 146 may be compression crimped to the electrical conductors 142. Each of the terminals 66 may be a signal terminal, a ground terminal, or a power terminal.

The insulator 144 includes a base 152, a terminating segment 153 that extends outward from the base 152, a platform 154 that extends outward from the base 152, and a grate 155. The terminating ends 146 of the terminals 66 extend along the terminating segment 153 of the insulator 144 for electrical connection to the corresponding electrical conductors 142 of the cable 22.

The mating ends 148 of the terminals 66 are arranged along the platform 154, which includes a terminal side 156, an opposite side 158, and side ends 160 and 162. The grate 155 is configured to be received within an opening 108 of the platform 154. The grate 155 includes grooves 110 and ribs 112 that extend between the grooves 110. The ribs 112 have tip surfaces 114 that are coplanar (i.e., approximately extend within a common plane 116), as can be seen in FIG. 7.

In the illustrated embodiment, the insulator 144 is manufactured from multiple pieces, namely the grate 155 and the remainder of the insulator 144. Alternatively, the insulator 144 is manufactured from a single piece (e.g., the grate 155 is integrally formed with the remainder of the insulator 144. The insulator 144 may be manufacture from any number of pieces.

Referring again to FIG. 6, the mating surfaces 150 of the mating ends 148 of the terminals 66 define a mating interface 164 of the terminal subassembly 126 where the mating surfaces 150 mate with the corresponding terminals 40 (FIGS. 3-5 and 8) of the electrical connector 12. The mating surfaces 150 of the terminals 66 are arranged along the terminal side 156 of the platform 154. Accordingly, the mating interface 164 of the connector 14 extends on the terminal side 156 of the platform 154. The mating ends 148 of the terminals 66 are deflectable springs that are configured to deflect generally in the direction of the arrow A when mated with the terminals 40 of the connector 12.

The mating interface 164 of the terminal subassembly 126 is approximately flat. For example, the mating surface 150 of each of the terminals 66 is approximately flat, at least once the mating end 148 is deflected after being mated with the corresponding terminal 40. The mating ends 148, and thus the mating surfaces 150, of the terminals 66 are arranged side by side in a row 118. The mating surfaces 150 of the terminals 66 extend approximately within the same plane 120. The approximately flat shapes of the mating surfaces 150 and the alignment within the common plane 120 provides the mating interface 164 of the connector 14 as approximately flat. The approximately flat mating interface 164 may provide a wipeable and/or cleanable surface for cleaning the mating surfaces 150 of the terminals 66. For example, a user may use their thumb, a cloth, and/or the like to wipe across the mating interface 164 to clear debris, dirt, other contaminants, and/or the like from the terminals 66. Moreover, the approximately flat mating interface 164 may trap less dirt, debris, other contaminants, and/or the like than the mating interfaces of at least some known electrical connectors. The approximately flat mating interface 164 may thus enable the mating surfaces 150 of the terminals 66 to be more reliable and/or be more easily cleaned than the terminals of at least some known electrical connectors. For example, the approximately flat mating interface 164 may enable the mating surfaces 150 of the terminals 66 to be cleaned without damaging the terminals 66. The approximately flat mating interface 164 may provide the connector 14 with a lower profile than at least some known electrical connectors.

As can be seen in FIG. 6, the mating ends 148 of the terminals 66 are aligned with corresponding grooves 110 of the grate 155. The mating ends 148 are configured to be deflected into or further into the corresponding grooves 110 when the mating ends 148 are mated with the terminals 40 of the connector 14. The ribs 112 of the grate 155 are configured to protect the mating ends 148 of the terminals 66 from over-deflection. Specifically, the common plane 116 (FIG. 7) of the tip surfaces 114 of the ribs 112 is aligned with a predetermined deflected position of the mating ends 148 that represents a maximum desired deflection of the mating ends 148. Accordingly, as a structure (e.g., the electrical connector 12) engages the mating ends 148 of the terminals 66, the structure will engage the tip surfaces 114 of the ribs 112 such that the structure cannot move the mating surfaces 150 of the mating ends 148 past the tip surfaces 114. The ribs 112 thus prevent the mating ends 148 from being deflected to or past a position where the mating ends 148 are damaged from being deflected past the working range of the mating ends 148.

Referring again to FIG. 7, the metal shell 94 extends a length from a mating end 174 to an opposite terminating end 176. The metal shell 94 is configured to receive the electrical conductors 142 of the cable 22 through the terminating end 76. The mating end 174 of the metal shell 94 includes a terminal opening 122. Optionally, the metal shell 94 includes a groove 182 that receives the sealing ring 106. The metal shell 94 optionally includes securing features 92 for securing the connector 14 to the connector 12 when the connectors 12 and 14 are mated together. In the illustrated embodiment, the securing features 92 include the pins 92 that are configured to be received by the electrical contacts 90*a* (FIGS. 3 and 8) of the metal shell 24 (FIGS. 1-5 and 8) to electrically and mechanically connect the metal shell 24 of the connector 12 to the metal shell 94 of the connector 14. Other types of securing features 92 may additionally or alternatively be used to electrically and/or mechanically connect the metal shells 24 and 94 together.

The metal shell 94 may include any metallic materials, such as, but not limited to, aluminum, copper, gold, silver, nickel, titanium, magnesium, platinum, another metal, and/or the like. In some embodiments, the metal shell 94 includes an aluminum alloy, a copper alloy, a gold alloy, a silver alloy, a nickel alloy, a titanium alloy, a magnesium ally, a platinum alloy, another metal alloy, and/or the like. Moreover, in some embodiments, an approximate entirety or a majority of the metal shell 94 is fabricated from one or more metals and/or metal alloys. In some embodiments, at least 90% of the metal shell 94 is fabricated from one or more metals and/or metal alloys. In the exemplary embodiment of the metal shell 94, an approximate entirety of the metal shell 94 is fabricated from one or more metals and/or metal alloys. Optionally, the metal shell 94 includes a base material (not shown) that is coated (e.g., plated and/or the like) with one or more different materials, whether or not the base material and/or the coating includes a metal and/or a metal alloy. One example of fabricating less than an approximate entirety of the metal shell 94 from one or more metals and/or metal alloys includes providing the metal shell 94 with a base material of one or more metals and/or metal alloys that is coated with one or more non-metallic materials, or vice versa. Any non-metallic materials that the metal shell 94 includes may or may not be electrically conductive.

The metal shell 94 is electrically conductive. Specifically, at least a portion of the metal shell 94 is electrically conductive such that the metal shell 94 defines an electrical path through the connector 14. In some embodiments, an approximate entirety of the metal shell 94 is electrically conductive. In other embodiments, one or more segments (e.g., a coating, a base material, and/or the like) is not electrically conductive. The electrical conductivity of the metal shell 94 enables the metal shell 94 to electrically shield the terminal subassembly 126. The electrical shielding may prevent or reduce electromagnetic interference (EMI) and/or radio frequency interference (RFI) on the signal paths defined through the connector 14. Such electrical shielding may allow relatively high speed data to be uninterrupted by the connector 14. In the illustrated embodiment, the metal shell 94 is manufactured from a single piece, but the metal shell 94 may alternatively be manufactured from two or more pieces that connect together to define the metal shell 94.

The metal shell 94 has a thickness $T_2$. The thickness $T_2$ may have any value. Various parameters of the metal shell 94 may be selected to provide the metal shell 94, and thus the connector 14, with a predetermined strength. Examples of such various parameters include, but are not limited to, the thickness $T_2$, the particular metallic materials of the metal shell 94, and/or the like. The predetermined strength of the metal shell 94 may reduce the likelihood that the metal shell 94 will structurally fail (e.g., fracture, break, collapse, and/or the like) during use within relatively rugged environments, such as, but not limited to, use when mounted to a wearable article, use within battlefields or other combat situations, field use, use within manufacturing facilities, use within construction sites, and/or the like. The predetermined strength of the metal shell 94 may enable the metal shell 94 to better protect the terminal sub-assembly 126 in relatively rugged environments. The predetermined strength of the metal shell 94 may enable the metal shell 94 to provide an increased amount of protection to the terminal subassembly 126 than at least some known electrical connectors. Examples of the thickness $T_2$ include, but are not limited to, between approximately 0.5 mm and approximately 2.0 mm, at least approximately 0.5 mm, and/or the like.

The metal shell 94 has the cross-sectional shape of an oval. Specifically, the metal shell 94 has the cross-sectional shape of an oval taken along a cross section that extends approximately perpendicular to the length of the metal shell 94. The oval cross-sectional shape of the metal shell 24 may facilitate providing the metal shell 94, and thus the connector 14, with a relatively low profile, which may facilitate use of the connector 14 when held by the wearable article. The oval cross-sectional shape of the metal shell 94 may provide the metal shell 94 with a lower profile than at least some known electrical connectors.

Referring again to FIG. 6, the mating end 174 of the metal shell 94 surrounds the side 158, the side end 160, and the side end 162 of the platform 154 of the insulator 144. The terminal side 158 of the platform 154 is exposed through the mating end 174 of the metal shell 94 such that the mating ends 148 of the terminals 66 are exposed through the mating end 174 of the metal shell 94. Specifically, the mating surfaces 150 of the terminals 66 are (and thus the mating interface 164 of the connector 14 is) exposed through the terminal opening 122 of the metal shell 94. The mating interface 164 of the connector 14 is thus exposed for mating with the connector 12.

In the illustrated embodiment, the connector 14 includes a boot 123 that seals the terminating end 178 of the metal shell 94. The seal provided by the boot 123 may enable the connector 14 to be water tight. In addition or alternatively, the connector 14 may include a grommet (not shown) and/or the cable 22 may sealingly engage the metal shell 94 to seal the terminating end 178 of the metal shell 94.

Although six are shown, the connector 14 may include any number of the terminals 66. Optionally, four of the terminals 66 may be configured to operate at any USB standard, protocol, and/or the like, such as, but not limited to, USB 1.0, USB 2.0, USB 3.0, and/or the like.

Figure 8:
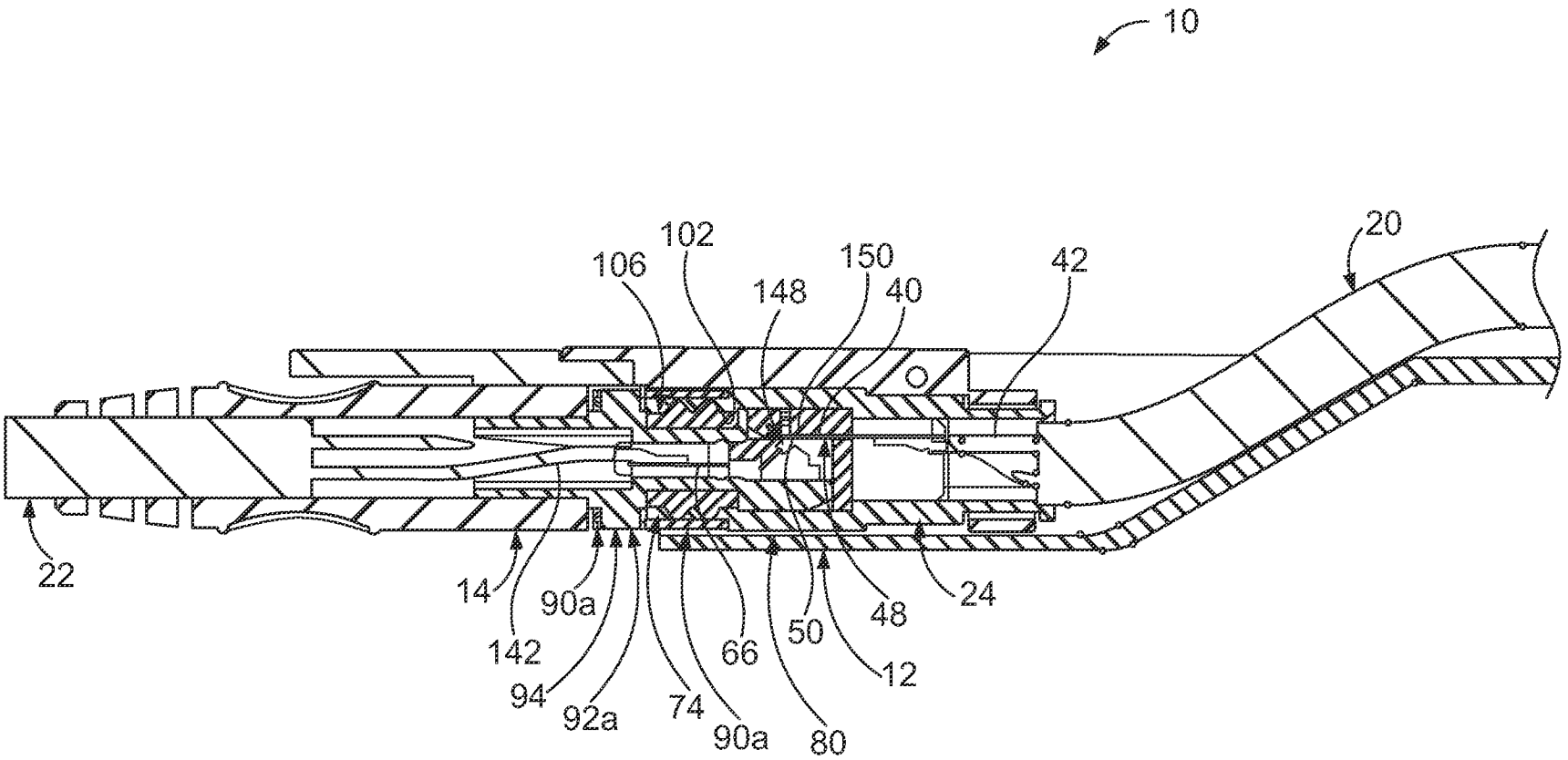
FIG. 8 is a cross-sectional view of the connector system shown in FIG. 1.

FIG. 8 is a cross-sectional view of the electrical connector system 10 illustrating the electrical connectors 12 and 14 mated together. The metal shell 94 of the connector 14 is received within the open mating end 74 of the tunnel 80 of the connector 12. The mating surfaces 150 of the terminals 66 of the connector 14 are engaged with the mating surfaces 50 of the corresponding terminals 40 of the connector 12 such that the terminals 66 are electrically connected to the corresponding terminals 40. The connectors 12 and 14 thus mate together within the tunnel 80 to establish an electrical connection between the electrical conductors 42 of the cable 20 and the electrical conductors 142 of the cable 22. The sealing ring 106 of the connector 14 is sealingly engaged with the interior surface 102 of the tunnel 80 to seal the open mating end 174 of the tunnel 80. The seal provided by the sealing ring 106 may provide the mated interface between the connectors 12 and 14 within the tunnel as water tight.

The electrical contacts 90*a* of the metal shell 24 of the connector 12 are engaged with the electrical pins 92*a* of the metal shell 94 of the connector 14 such that the metal shells 24 and 94 are electrically and mechanically connected together. Although the electrical pins 92*a* engage the electrical contacts 90*a* with a snap-fit connection in the illustrated embodiment, any other type of connection may additionally or alternatively be used. The mechanical connection between the electrical contacts 90*a* and the electrical pins 92*a* may provide a visual indication that the connectors 12 and 14 are fully mated together. The electrical connection between the metal shells 24 and 94 enables the metal shells 24 and 94 to electrically shield the connector system 10, which may prevent or reduce electromagnetic interference (EMI) and/or radio frequency interference (RFI) on the signal paths defined through the connector system 10. Such electrical shielding may allow relatively high speed data to be uninterrupted by the connector system 10.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector system comprising:

a first connector having a first terminal subassembly and a first metal shell, the first terminal subassembly being held by the first metal shell and comprising a first group of terminals, the first metal shell comprising a sealing ring; and a second connector configured to mate with the first connector, the second connector having a second metal shell and a second terminal subassembly that is held by the second metal shell, the second terminal subassembly comprising a second group of terminals that is configured to mate with the first group of terminals of the first connector, the second metal shell comprising a terminating segment and a tunnel that extends outward from the terminating segment, the tunnel having an open end defined by at least one interior surface of the tunnel, the first metal shell being configured to be received within the open end of tunnel such that the first and second connectors mate together within the tunnel, wherein the sealing ring is configured to sealingly engage with the interior surface of the tunnel to seal the open end of the tunnel when the first and second connectors are mated together within the tunnel;

wherein the first connector is configured to terminate to a plurality of electrical conductors, the first terminal subassembly having an insulator that includes grooves and ribs, the ribs extending between adjacent grooves, the first group of terminals being held by the insulator, the first group of terminals having terminating ends that are configured to be electrically connected to the electrical conductors, the first group of terminals having mating ends that include mating surfaces where the first group of terminals are configured to mate with the second connector, the mating ends being deflectable springs that are aligned with corresponding grooves in the insulator, the mating ends being deflectable into the corresponding grooves, wherein the ribs are configured to protect the mating ends of the first group of terminals from overdeflection.

2. The electrical connector system of claim 1, further comprising a holder configured to be secured to a wearable article, the holder comprising a shroud that defines a chamber of the holder, the second metal shell being held by the holder within the chamber, the tunnel extending within the chamber outward from the terminating segment of the second metal shell toward an entrance to the chamber.

3. The electrical connector system of claim 1, wherein at least one of the first connector or the second connector comprises at least one of a grommet or a boot that is configured to seal a terminating end of the first or second metal shell, respectively.

4. The electrical connector system of claim 1, wherein the tunnel is an integral structure of the second metal shell.

5. The electrical connector system of claim 1, wherein the first and second connectors comprises securing features that when mechanically connected together provide a visual indication that the first and second connectors are fully mated together.

6. The electrical connector system of claim 1, wherein the first metal shell comprises a mating end and an opposite terminating end, the first connector further comprising at least one of a grommet or a boot engaged with the first metal shell at the terminating end for sealing the first metal shell to the electrical conductors at the terminating end.

7. The electrical connector system of claim 1, wherein the second connector is configured to terminate to a plurality of electrical conductors, the second group of terminals configured to be electrically connected to the electrical conductors, the second terminal subassembly having an insulator holding the second group of terminals, the second terminal subassembly having a mating interface where mating surfaces of the second group of terminals mate with the first connector, the mating interface being approximately flat, the second metal shell of the second connector that holds the second terminal subassembly having the cross-sectional shape of an oval.

8. The electrical connector system of claim 7, wherein the insulator of the second terminal subassembly comprises a platform, the mating surfaces of the second group of terminals being arranged along the platform such that the mating interface of the second terminal subassembly extends on the platform, the tunnel of the second metal shell surrounding the platform, wherein the tunnel is spaced apart from the platform along at least three sides of the platform.

9. The electrical connector system of claim 7, wherein the mating surfaces of the second group of terminals are approximately flat and are arranged side by side within approximately the same plane to define the approximately flat mating interface of the second terminal subassembly.

10. The electrical connector system of claim 1, further comprising a holder configured to be mounted to a wearable article, the second metal shell of the second connector being held by the holder such that the second connector is configured to be held by the wearable article.

11. The electrical connector system of claim 1, wherein at least one of the first metal shell or the second metal shell has the cross-sectional shape of an oval, the oval cross-sectional shape being at least one of oblong, elliptical, a rectangle with rounded corners, or the shape of an egg.

12. The electrical connector system of claim 1, wherein at least one of the first group of terminals or the second group of terminals are electrically connected to electrical conductors, the electrical conductors being at least one of electrical conductors of a cable or electrical conductors of an e-textile.

13. The electrical connector system of claim 1, wherein the ribs comprise tip surfaces that extend approximately within a common plane, the common plane of the tip surfaces being aligned with a predetermined deflected position of the mating surfaces of the first group of terminals that represents a maximum desired deflection of the mating ends of the first group of terminals.

14. The electrical connector system of claim 1, wherein the insulator of the first terminal subassembly comprises a platform having a terminal side, an opposite side, and two side ends that extend from the terminal side to the opposite side, the mating ends of the first group of terminals being arranged along the terminal side of the platform, the first metal shell surrounding the side ends and the opposite side of the platform, the terminal side of the platform being exposed through the first metal shell such that the mating surfaces of the first group of terminals are exposed for mating with the second connector.

15. The electrical connector system of claim 1, wherein the first metal shell has the cross-sectional shape of an oval.

16. The electrical connector system of claim 1, wherein the second terminal subassembly has a mating interface where mating surfaces of the second group of terminals mate with the first connector, the mating surfaces of the second group of terminals are approximately flat and are arranged side by side within approximately the same plane such that the mating interface is approximately flat.

* * * * *